US006561607B1

(12) United States Patent
Lubinsky et al.

(10) Patent No.: US 6,561,607 B1
(45) Date of Patent: May 13, 2003

(54) APPARATUS AND METHOD FOR MAINTAINING A SUBSTANTIALLY CONSTANT CLOSELY SPACED WORKING DISTANCE BETWEEN AN INKJET PRINTHEAD AND A PRINTING RECEIVER

(75) Inventors: Anthony R. Lubinsky, Penfield, NY (US); Simon D. Yandila, Rochester, NY (US); Diane C. Freeman, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/680,378

(22) Filed: Oct. 5, 2000

(51) Int. Cl.[7] ..... B41J 25/308
(52) U.S. Cl. ..... 347/8
(58) Field of Search ..... 400/55–59; 347/8, 347/37, 4, 2

(56) References Cited

U.S. PATENT DOCUMENTS

| | | | | |
|---|---|---|---|---|
| 3,683,396 A | | 8/1972 | Keur et al. | |
| 4,368,474 A | | 1/1983 | Togawa et al. | |
| 4,513,299 A | | 4/1985 | Lee et al. | |
| 4,580,914 A | | 4/1986 | Rich et al. | |
| 4,597,794 A | * | 7/1986 | Ohta et al. | 106/20 |

(List continued on next page.)

FOREIGN PATENT DOCUMENTS

| | | |
|---|---|---|
| EP | 0 389 738 A | 10/1990 |
| EP | 0 473 178 A | 3/1992 |
| JP | 63 212585 A | 9/1988 |
| JP | 2-184449 A | 7/1990 |
| WO | WO 98/08687 | 3/1998 |

*Primary Examiner*—Thinh Nguyen
*Assistant Examiner*—Ly T Tran
(74) *Attorney, Agent, or Firm*—Norman Rushefsky

(57) ABSTRACT

The present invention resides in an apparatus (8) and method for maintaining a print head (10) at a substantially constant, closely spaced working distance (22) from a surface (17) of a printing receiver (16) during relative translational movement between the print head (10) and the receiver (16) along a predetermined path of movement for depositing liquid or ink droplets (12) onto the surface (17), the apparatus (8) including an actuator (20) connected to the print head (10) and controllably actuable for moving the print head (10) toward and away from the receiver (16), an element (35,36) for detecting a representative distance between the print head (10) and locations on the surface (17) of the receiver (16) along the path of movement and generating a signal having a value representative of or related to the representative distance, an element (46) for comparing the signal value to a reference; value representative of the working distance (22) for determining a difference between the signal value and the reference value and generating a control signal representative of the difference, and a control element (24) for receiving the control signal and responsively controllably actuating the actuator (20) to move the print head (10) toward or away from the receiver (16) to locate the print head (10) at the working distance (22) from the locations on the surface (17) of the receiver (16) when the print head (10) is positioned for depositing the liquid or ink droplets thereon. The method of the present invention includes the steps of (a) generating signals representative of distances between the print head (10) and the locations on the surface (17) of the receiver (16) along the path of movement prior to the print head (10) being positioned for depositing liquid or ink droplets onto the locations on the surface (17), respectively; and (b) responsively to the signals, as required, moving the print head (10) toward or away from the receiver (16) to locate the print head (10) at substantially the closely spaced working distance (22) from the locations on the surface (17) of the receiver (16) when positioned for depositing the liquid or ink droplets thereon, respectively.

23 Claims, 1 Drawing Sheet

Figure 1:
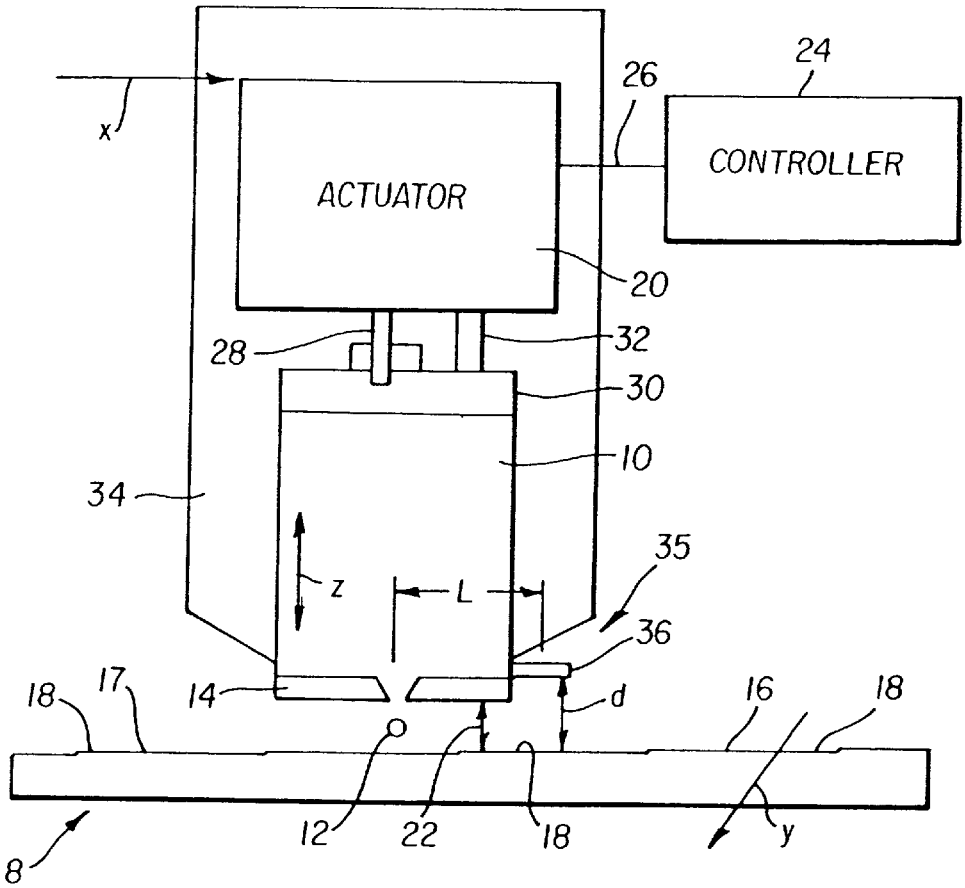

U.S. PATENT DOCUMENTS 4,652,153 A 3/1987 Kotsuzumi et al.
4,972,211 A 11/1990 Aoki
5,245,364 A * 9/1993 Uchida et al. ..... 347/104
5,303,141 A 4/1994 Batchelder et al.
5,360,276 A 11/1994 Petermann
5,361,084 A 11/1994 Patton et al.
5,428,375 A 6/1995 Simon et al.
5,461,406 A 10/1995 Lorenze, Jr. et al.
5,468,076 A 11/1995 Hirano et al.
5,495,270 A 2/1996 Burr et al.
5,757,389 A * 5/1998 Schwede et al. ..... 347/4
5,796,416 A 8/1998 Silverbrook
5,854,643 A * 12/1998 Katsuyama ..... 347/8
5,894,036 A 4/1999 Tylko
5,901,425 A 5/1999 Bibl et al.
6,036,302 A 3/2000 Hotomi
6,044,762 A 4/2000 DeBoer et al.
6,076,909 A * 6/2000 Saeki et al. ..... 34/8

* cited by examiner

APPARATUS AND METHOD FOR MAINTAINING A SUBSTANTIALLY CONSTANT CLOSELY SPACED WORKING DISTANCE BETWEEN AN INKJET PRINTHEAD AND A PRINTING RECEIVER

FIELD OF THE INVENTION

The present invention relates generally to imaging apparatus and methods, and more particularly, to apparatus and a method for maintaining a substantially constant closely spaced working distance between a nozzle plate of a ink jet print head and a surface of a medium or element for receiving liquid or ink droplets as the droplets are being deposited on the receiving medium or element during relative movement of the print head and the medium or element.

BACKGROUND OF THE INVENTION

Ink jet imaging devices use the controlled ejection of small droplets of liquid, to produce an image. Typically, the liquid is ejected through one or more nozzle orifices located in a nozzle plate of a print head. The ejection of the liquid, for instance, ink, through the respective nozzles is effected by a pressure pulse, which in the instance of a piezoelectric print head, is generated by application of an electrical drive waveform to an electromechanical transducer, and in a thermal print head, by application of a waveform to an electrothermal transducer or a resistor.

A problem with known ink jet printing apparatus is that ink droplets ejected from a nozzle orifice may emerge or travel in a direction that varies from the intended direction which is usually perpendicular to the surface of the nozzle plate. Such misdirection can arise from physical causes including a nozzle imperfection or a deposit or deposits on a surface of the nozzle, and can result in an error in the final location of the dot produced by the ink droplet on the receiving medium or element with respect to a desired or intended location of the dot. Such locational errors can result in artifacts in the printed image, such as visible bands and the like.

One contemplated solution for decreasing the severity of such locational errors in dot placement is to reduce the distance between the nozzle plate and the ink receiving medium or element, which is referred to as the working distance. This solution may be beneficial for applications requiring very high image quality and dot placement accuracy, as for example graphic arts printing, in which the spatial frequency of the micro-dots forming the image may be very high: for instance, 1200–2400 dots/inch or higher. In several prior art printing applications, requiring lesser dot placement accuracies, the working distance may be set relatively large, for instance, ink jet printers typically used for home and business applications wherein the working distance is generally 1 to 1 ½ millimeters to accommodate varying paper thicknesses. However, for other applications in which it is desirable to set the working distance to a much smaller value, for example, on the order of 100 to 1000 microns, decreasing the working distance poses the danger of collision or contact between the print head and the receiver, which can result in damage to or destruction of the print head and/or the receiver. Also, the liquid, when ejected from a nozzle typically consists of a liquid droplet having a connected ligament or trailing tail. Some distance of travel from the ejecting nozzle is required for the liquid structure to coalesce into a single or unitary droplet desirable for producing a satisfactory dot. Therefore, the working distance is desired to be small, but not so small as to provide insufficient distance above the receiver surface for coalescence. If the working distance is not sufficiently large to provide the required travel distance, the liquid objects will impinge the surface of the ink receiving medium or element before being completely formed which may result in comet shaped or other undesirable marks on the surface. And, if the working distance is not maintained substantially constant, variations in the printed dots can be present.

To compound the problems in maintaining a substantially constant working distance, typically during ink jet printing, the print head and ink receiving medium or element are moving transversely one relative to the other in at least one direction or along at least one axis. For instance, the ink receiving medium or element will be moved or translated in a direction indicated as y, while the print head maybe moved or scanned across the receiving medium or element in a direction indicated as x. Velocities of movement, for example in the instance of large format printing apparatus, can range up to about 1 meter per second. Such movement can result in variations in the working distance between the print head and the surface of the receiving medium or element due to any of several factors, including, for instance, variances in thickness of the ink receiving medium or element and/or non-flatness of the ink receiving surface thereof, such as a that due to a bow in a platen used for vacuum hold-down of a receiver for printing, or imperfections in the transport or support apparatus for moving the print head and/or the receiving medium or element one relative to the other, for instance, in the case of a cylindrical or roll shaped receiving medium, an eccentricity which results in variations of the working distance when the medium is rotated.

Various methods and apparatus are known for moving and positioning print heads or nozzles for depositing ink and other materials onto surfaces of substrates and other receivers. Reference in this regard, Hirano et al. U.S. Pat. No. 5,468,076 issued Nov. 21, 1995 to Kabushiki Kaisha Tec of Japan which discloses several embodiments of a print gap adjusting device; Petermann U.S. Pat. No. 5,360,276 issued Nov. 1, 1994 to Siemens Nixdorf Informationssysteme Aktiengesellschaft of Germany which discloses a printing device with adjustable printing head gap; and Kotsuzumi et al. U.S. Pat. No. 4,652,153 issued Mar. 24, 1987 which discloses a wire dot-matrix printer. However, all of these devices are directed to the problem of statically sensing the thickness of a receiver or paper placed on a platen, and then adjusting a print head-to-platen gap accordingly, prior to printing. This is in contrast to the present invention, which dynamically senses a print head-to-receiver gap and uses the sensed signal to keep this gap constant, during printing. In addition, all the above cited devices rely either on contact with the paper or other printing receiver or stored data to determine the print gap value to be used. Reliance on contact with the receiver can be a disadvantage in that wear, dirt build-up, and/or marring or other marking of the receiver surface or ink or other material previously deposited on the surface can occur due to the contact. And, reliance on stored gap values may be disadvantageous if the values do not correspond to the actual value required for a particular instance.

Reference also, Tylko U.S. Pat. No. 5,894,036 issued Apr. 13, 1999, which discloses a three dimensional plotter which maintains an ink droplet, or bead, by coordinating the delivery rate of the ink through the dispensing nozzle with the dispensing nozzle height and velocity; and Batcheleder U.S. Pat. No. 5, 303,141, issued Apr. 12, 1994 to International Business Machines Corporation which discloses a model generation system having closed—loop extruding nozzle positioning which includes apparatus for generating a feedback signal that is indicative of at least one characteristic of a most recently extruded portion of material extruded through the nozzle, which apparatus can include, for instance, a visual or infrared emission imaging system, a proximity detecting apparatus such as a capacitive sensor, a tactile sensor, or a pneumatic sensor. However, these disclosures refer to methods for coating a material like a slurry, or adhesive, onto a surface, in which a continuous-pressure pump is used to maintain a contiguous bead of coating material, between the nozzle and the receiver. This is in contrast to the case of the present invention, in which a drop of liquid is broken off from the nozzle by a discontinuous pressure pulse, and travels to the receiver. In addition, these referenced apparatus and methods do not disclose a means for maintaining a substantially constant closely spaced working distance between an ink jet print head and a surface of a receiver for receiving ink droplets therefrom during a printing operation wherein a print head and the receiver are moved one relative to the other.

Therefore, there is a need to provide apparatus and a method for maintaining a substantially constant closely spaced working distance between an ink jet print head and an ink receiving surface during a printing operation wherein the ink receiving medium or element may vary in thickness and/or flatness, and/or the transport system for moving the print head and/or the receiver may be imperfect or imperfectly aligned, and which apparatus and method does not necessitate reliance on contact with the receiver or predetermined gap values.

SUMMARY OF THE INVENTION

An object of the present invention is to provide apparatus and a method for maintaining a substantially constant closely spaced working distance between an ink jet print head and an ink receiving printing medium or element during printing and which does not require contact with the receiver or reliance on stored distance values.

With this object in view, the present invention resides in an apparatus and system for maintaining a print head at a substantially constant, closely spaced working distance from a surface of a printing receiver during relative translational movement between the print head and the receiver along a predetermined path of movement while liquid or ink droplets are being deposited onto the surface by the print head, the apparatus including an actuator connected to the print head and controllably actuable for moving the print head toward and away from the receiver, an element for detecting a representative distance between the print head and locations on the surface of the receiver along the path of movement and generating a signal having a value representative of the representative distance, an element for comparing the signal value to a reference value representative of the working distance for determining a difference between the signal value and the reference value and generating a control signal representative of the difference, and a control element for receiving the control signal and responsively controllably actuating the actuator to move the print head toward or away from the receiver to locate the print head at the working distance from the respective locations on the surface of the receiver when the print head is positioned for depositing the liquid or ink droplets thereon.

The present invention also resides in a method for maintaining the substantially constant closely spaced working distance between the ink jet print head and the surface of the printing receiver as the print head and the receiver are moved transversely one relative to the other along the path of movement, and the liquid or ink droplets are being deposited onto the surface including the steps of (a) generating signals representative of distances between the print head and locations on the surface of the receiver along the path of movement prior to the print head being positioned for depositing liquid or ink droplets onto the locations on the surface, respectively; and (b) responsively to the signals, as required, moving the print head toward or away from the receiver to locate the print head at substantially the closely spaced working distance from the locations on the surface of the receiver when positioned for depositing the liquid or ink droplets thereon, respectively.

According to an exemplary embodiment of the present invention, the receiver is translated in one direction, while the print head may be scanned across the receiver in another direction. The element for detecting the representative distance between the print head and the locations on the surface of the receiver and generating the signal representative of the representative distance comprises a capacitive circuit wherein one plate of the capacitor is formed by a conductive portion or layer of the printing receiver and the other plate is a component of the print head, for example, an electrode attached to the print head, or a nozzle plate of the print head having conductive properties. In this way, as the print head and the printing receiver are relatively moved, the capacitance will vary according to the distance and circuitry is provided to generate a corresponding signal which will be representative of the changing distance. Circuitry including a comparator is provided for receiving the signal representative of the representative distance and comparing it to a known or predetermined value for the desired working distance for generating the control signal, the control signal being provided to the control element for controllably actuating the actuator. The actuator, for example, can be a stepper motor, which turns a threaded shaft connected to the print head, the control element comprising a stepper motor drive. A biasing element, for example, a spring, can be used for biasing the movement of the print head for reducing hysteresis and backlash in the threaded movement of the print head. As an alternative, for instance, wherein the printing receiver does not possess conductive properties, the element for detecting the distance between the print head and the locations on the surface of the receiver along the path of movement can include another sensor construction such as an optical distance sensor.

A feature of the present invention is the provision of an ink jet printer including apparatus for maintaining a substantially constant closely spaced working distance between the print head thereof and a printing receiver.

Another feature of the invention is the provision of a feedback system adapted for determining representative distances between the print head and locations on a surface of the receiver onto which liquid or ink droplets will be deposited during the printing operation and moving the print head toward or away from the receiver to locate the print head at the desired working distance from the receiver when positioned for depositing the droplets on the respective surface locations.

As an advantage of the present invention a substantially constant closely spaced working distance is maintained between the ink jet print head and the printing receiver for more accurately produced dots on the receiver.

As another advantage, variances in printed dots and artifacts due to an inconsistent working distance can be reduced.

According to the invention, a substantially constant closely spaced working distance is maintained between an ink jet print head and an ink receiving printing medium or element resulting in improved print quality with less artifacts.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTIONS OF THE DRAWINGS

Figure 2:
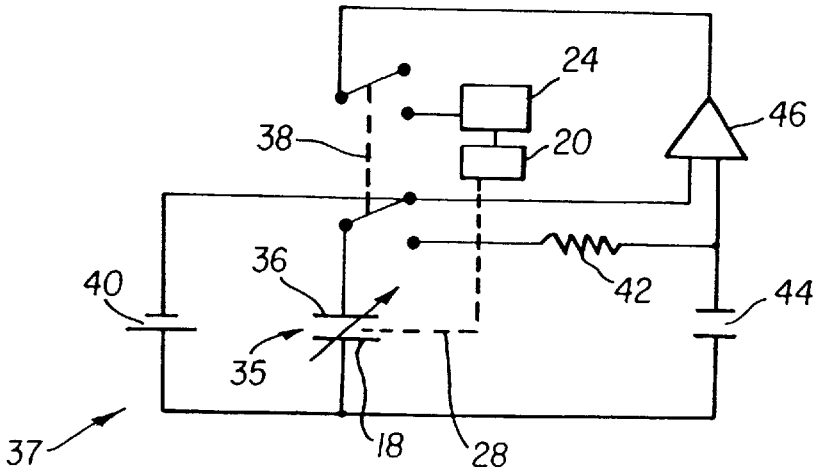

While the specification concludes with the claims particularly pointing out and distinctly claiming the subject matter of the present invention, it is believed the invention will be better understood from the following detailed description when taken in conjunction with the accompanying drawings wherein:

FIG. 1 is a simplified schematic view of an ink jet print head including apparatus and a system for maintaining a substantially constant closely spaced working distance between the print head and a printing receiver according to the present invention; and FIG. 2 is a schematic of a circuit for one embodiment of the apparatus and system according to the invention.

DETAILED DESCRIPTION OF THE INVENTION

The present description will be directed in particular to elements forming part of, or cooperating more directly with, an apparatus 8 and method in accordance with the present invention. It is to be understood that elements not specifically shown or described may take various forms well known to those skilled in the art.

Therefore, referring to FIG. 1, an ink jet print head 10 of apparatus 8 is shown, ejecting a liquid drop 12 through a nozzle plate 14, onto a selected location on a surface 17 of a receiver 16, while the print head 10 and the receiver 16 are being relatively moved along a predetermined path of movement. In typical practice, during the printing operation, that is, as the drops 12 are being deposited on particular or selected locations on the surface 17, the receiver 16 may be moved or translated in the direction indicated as y, which is into and out of the drawing as the apparatus is presently depicted, while the print head 10 may be moved or scanned across the receiver 16 in the direction indicated as x. The receiver 16 includes one or more metallic layers 18, as is a common construction for plates for printing, in which case the receiver 16 may be a grained, anodized, aluminum plate. The nozzle plate 14 is representative of nozzle plates made by any of several common commercially used methods and may be composed of any of several materials, for example, electroplated nickel or gold.

In the present invention, the print head 10 is in mechanical communication or connection with an actuator 20, operable for moving the print head 10 in the direction indicated as z toward or away from receiver 16 for changing a working distance 22 during the printing operation, as will be explained. The working distance 22 will typically have a value within a range of from about 100 to about 1000 microns. Here, it should be noted that the desired working distance 22 to be maintained may vary as between different print heads and/or different printing applications, it being contemplated that as a minimum for most print heads and applications the working distance selected should be sufficiently large for a discrete droplet emitted from a nozzle of the print head to pass through the air and coalesce into an object of the desired shape and size, for instance, a generally spheroid, elliptoid, or similar shape object having a diameter of about 35 microns or less, before impinging the surface 17 of the receiver 16. The actuator 20 may be, for example, a well known commercially available stepper motor. The actuator 20 is connected in electrical communication with and is electrically controlled by a controller 24, which may be, for example, a stepper motor drive, over a conductive path 26. The controller 24 is adapted for receiving an input or control signal, which is preferably a voltage signal, to operate the actuator 20 to turn at a speed proportional to the voltage. Optionally, the controller 24 may also include circuitry for effecting a time delay between receipt of the input control signal, and actuation of the motor. The time delay may be driving relation to a threaded shaft 28, which is threadedly connected to a receiving connector 30 such as a drive not non-rotatably mounted to the print head 10. A spring 32 is disposed between actuator 20 and print head 10 to maintain the mechanical connection in tension to limit hysteresis and backlash in the movement of print head 10. The actuator 20 is mounted on a support assembly 34, which can be scanned in the x-direction, and which also carries the print head 10, on glides or ways (not shown) such that the print head 10 is free to execute sliding motion in the z-direction relative to the receiver 16.

The metallic layer or layers 18 of receiver 16 form one plate of a capacitor 35, and an electrode 36 mounted to the print head 10 forms the other plate, to allow a voltage to be applied across the layer or layers 18 and electrode 36. The capacitance of the thus formed capacitor 35 is proportional to A/d, where A is the electrode area, and d is the distance between the electrode 36 and a selected location on the surface 17 of the receiver 16. Distance d, in turn is of known relation to or is representative of the working distance 22 for the selected location.

When the print head 10 is in printing mode, during the relative movement between the print head 10 and receiver 16 along the predetermined path of movement, variations in the thickness of the receiver 16 as illustrated in FIG. 1, misalignment between the print head 10 and the receiver 16, and/or other irregularities, if sufficient in magnitude, will result in variances or changes in the representative distance d such that layer or layers 18 will vary in distance from the electrode 36. When layer or layers 18 vary in distance from electrode 36, the resultant capacitance and voltage on the electrode 36 will vary proportionally. According to the present invention, by sensing the changes in the voltage on electrode 36 during the relative movement, the changes in the representative distance d for selected locations along the path of movement can be detected or determined, and the position of the print head 10 in the z direction adjusted correspondingly such that when positioned for printing on the respective selected locations, the print head 10 will be at the desired working distance 22 from the respective selected locations.

Referring also to FIG. 2, there is shown a schematic of a preferred control circuit 37 for sensing the voltage on the electrode 36 for detecting changes in the distance d during the relative movement of the print head 10 and the receiver 16, and outputting a control signal representative thereof to control the actuator 20 for moving the print head 10 in the z direction. Examining the circuit, when the poles on a DPDT switch 38 are in the UP position, as shown, a voltage source 40 is connected across the variable capacitor 35 comprised of the electrode 36 and the metallic layer or layers 18 of receiver 16, causing the capacitor 35 to charge. This can be carried out, for example, when the print head 10 is in a home position over the receiver 16, preparing to print. Then, before the print head 10 is scanned across the receiver 16 in the printing mode, the poles of the switch 38 are thrown to the DOWN position. This causes the electrode 36 to be connected, through a low-pass filter network composed of a resistor 42 and a capacitor 44, to one of the inputs of a comparator 46. The filter removes high frequency noise from the electrode signal, and its RC time constant may be taken as a fraction of the swath time, that is, the time for the print head 10 to scan over the receiver 16. The comparator 46 compares the received signal voltage to the original charging voltage. If, during the relative movement, the representative distance d increases or decreases, the capacitance will change correspondingly, and the sensed voltage will change. The comparator 46 will then send a control signal proportional to this voltage difference to the controller 24. The sense of the voltage input is chosen such that the controller 24 produces a rotation of the actuator 20 which moves the print head 10 to correspondingly decrease or increase the working distance 22 via the threaded shaft 28. This motion will continue until the sensed voltage is equal to the original reference value, which positions the print head 10 at the desired working distance 22 from the respective selected locations on the surface 17 the receiver 16, thus effectively floating the print head 10 substantially 17 constantly at the working distance 22 relative to the receiver 16 during the printing operation.

Here, it can be observed in FIG. 1 that electrode 36 is advantageously positioned so as to be forward of the print head 10 along the path of relative movement of the print head 10 and the receiver 16 (as represented by the arrow x) such that the distance d for a selected location on the surface 17 of receiver 16 can be determined and the position of the print head 10 in the z direction changed (if required) during the movement prior to the print head 10 being positioned for printing on the selected location such that the working distance 22 is effectively maintained at a substantially constant value. A preferred manner of accomplishing this is to hardwire or program the controller 24 to delay the application of the actuation signal with respect to the input control signal, by an amount L/v, where L is the distance in the x direction between the center of the sensing electrode 36 and the nozzle, and v is the velocity of relative motion between the print head 10 and the receiver 16, in the x direction. As an alternative construction, the nozzle plate 14 itself can be used as the sensing, electrode 36 and thus the plate of the capacitor 35, if the nozzle plate 14 possesses conductive properties such as provided by the metallic plated layer as in the present instance. Thus, as the print head 10 and the receiver 16 are relatively moved along the path of movement, variations in the distance between the leading portion of nozzle plate 14 itself and successive selected locations on the surface 17 of the receiver 16 along the path of movement will result in corresponding capacitance variations and voltage signal variations in the circuit 37 described above, for use in the same manner to adjust the position of the print head 10 in the direction z so as to be at the working distance 22 when positioned for printing on each of the locations.

In both cases, the time response of the actuator-motor should be chosen to be small compared to the time required for a given point on the receiver to pass beneath the entire width, along x, of the sensing electrode 36. The width of sensing electrode 36 may be advantageously chosen as several millimeters, to average over small imperfections or cracks on the receiver surface. Since the variations in the working distance 22 are typically very small compared to the electrode width, the speed of travel produced by the actuator in the z-direction can advantageously be very small compared to the print head scanning speed, in the x-direction.

As still another alternative construction, if the receiver 16 does not include one or more metallic layers such as the layers 18 or does not otherwise possess a conductive property, the capacitive sensor arrangement described above can be replaced by an alternative sensor arrangement such as an optical distance sensor. For example, a common commercially available optical displacement meter which can sense either specular or diffuse reflection of a laser beam off a receiver surface, and calculate the working distance by triangulation, such as available from Motion Control Technology of Rochester, New York, can be used.

Therefore, a method and apparatus has been provided for mechanically controlling the working distance between the nozzle plate of the print head and a receiver surface, such as a flat surface or cylindrical surface, during the printing operation, useful for printing images requiring precise placement of the liquid drops on the receiving medium, as for example in graphic arts printing.

PARTS LIST

8 apparatus
10 ink jet print head
12 liquid drop
14 nozzle plate
16 receiver
17 surface
18 metallic layer
20 actuator
22 working distance
24 controller
26 conductive path
28 threaded shaft
30 receiving connector
32 spring
34 support assembly
35 capacitor
36 electrode
37 control circuit
38 DPDT switch
40 voltage source
42 resistor
44 capacitor
46 comparator

What is claimed is:

1. A method for dynamically maintaining a substantially constant closely spaced working distance between an ink jet print head and a surface of a printing receiver for depositing liquid or ink droplets onto the surface as the print head and the receiver are moved transversely one relative to the other along a path of movement, the method comprising the steps of:

(a) providing a component of a device useful for sensing spacing between a location on the receiver surface and the outlet of the nozzle of the print head, the component being provided at or proximate a nozzle outlet surface of the print head;

(b) using said component in the generating of signals by the device representative of distances between the print head and respective locations on the surface of the receiver along the path of movement just prior to the print head being positioned for depositing liquid or ink droplets onto said respective locations on the surface, respectively; and (c) responsively to the signals, as required, moving the print head toward or away from the receiver to locate the print head at substantially the closely spaced working distance from said respective locations on the surface of the receiver when positioned for depositing the liquid or ink droplets thereon, wherein the closely spaced working distance is between 100 microns and 1000 microns.

2. The method of claim 1, wherein the step of generating signals includes a step of detecting a proximity of the print head from the respective locations on the surface of the receiver.

3. The method of claim 2, wherein the step of detecting includes providing a signal value that varies proportionately with the distance between the print head and each of the locations on the surface of the receiver.

4. The method of claim 3, wherein the signal value is a function of capacitance of a capacitor formed by an element on the print head and the printing receiver at a respective location.

5. The method of claim 4, wherein the element on the print head comprises a conductive nozzle plate.

6. The method of claim 3, wherein the signal value is compared to a reference value to determine a difference value which is inputted to a controller for an actuator controllably operable for moving the print head toward or away from the receiver.

7. The method of claim 2 wherein during the step of detecting the proximity of the print head from the respective location on the surface of the receiver the print head is depositing liquid or ink droplets onto other locations on the surface.

8. The method of claim 1, wherein the signal is generated by a device operable for optically sensing the distance between the print head and each of the respective locations on the surface of the receiver.

9. The method of claim 1, wherein the working distance comprises a distance sufficient for each of the droplets to coalesce into an objects having a desired shape and size before being deposited onto the surface of the receiver.

10. The method of claim 9, wherein the desired shape is a generally spheroid shape and the size is about 35 microns.

11. The method of claim 1 and wherein the receiver and includes a metallic layer or layers.

12. The method of claim 11 and wherein the receiver is an aluminum plate.

13. A system for dynamically maintaining a print head at a substantially constant, closely spaced working distance from a surface of a printing receiver during relative translational movement between the print head and the receiver along a predetermined path of movement while depositing liquid or ink droplets onto the surface at selected locations along the path of movement, comprising:

an actuator connected to the print head and controllably actuable for moving the print head toward and away from the receiver;

an element for use in detecting respective distances between the print head and the selected locations on the surface of the receiver along the path of movement and generating respective signals having respective values representative of said respective distances, the element being located at or proximate a nozzle outlet plate of the print head and being spaced from the receiver surface at a working distance of between 100 microns and 1000 microns;

a device for comparing said signal values to a reference value representative of said working distance for determining respective differences between said signal values and said reference value and generating respective control signals representative of said differences; and a control element for receiving each of the control signals and responsively controllably actuating the actuator to move the print head toward or away from the receiver to locate the print head at the working distance from the selected locations on the surface of the receiver when the print head is positioned for depositing the liquid or ink droplets thereon.

14. The system of claim 13, wherein the element for use in detecting the respective distances between the print head and the selected locations on the surface of the receiver comprises a capacitor formed by an element on the print head and a conductive element of the receiver.

15. The system of claim 13, wherein the element for use in detecting the respective distances between the print head and the selected locations on the surface of the receiver comprises an optical distance sensor.

16. The system of claim 13, wherein the device for comparing comprises a comparator that is connected to the element for use in detecting the respective distances between the print head and the selected locations on the surface of the receiver.

17. The system of claim 13 and wherein the receiver includes a metallic layer or layers.

18. The system of claim 17 and wherein the receiver is an aluminum plate.

19. Apparatus for dynamically maintaining a print head at a substantially constant, closely spaced working distance from a surface of a printing receiver during relative translational movement between the print head and the receiver along a predetermined path of movement for depositing liquid or ink droplets onto selected locations on the surface, comprising:

an actuator connected to the print head and controllably actuable for moving the print head toward and away from the receiver;

an element for generating a respective distance related signal value representative of distance between the print head and each of the selected locations on the surface of the receiver and;

an element for comparing each said signal value to a reference value representative of said working distance for determining a difference between each said signal value and said reference value and generating a respective control signal representative of said difference; and a control element for receiving the respective control signals and responsively controllably actuating the actuator to move the print head toward or away from the receiver to locate the print head at the working distance from the selected locations on the surface of the receiver when the print head is positioned for depositing the liquid or ink droplets thereon, wherein the working distance is between 100 microns and 1000 microns.

20. The apparatus of claim 19, wherein the element for detecting the respective distances between the print head and the selected locations on the surface of the receiver comprises a capacitor formed by an element on the print head and a conductive element of the receiver.

21. The apparatus of claim 20, wherein the element on the print head comprises a conductive nozzle plate.

22. The apparatus of claim 19, wherein the element for detecting the respective distances between the print head and the selected locations on the surface of the receiver comprises an optical distance sensor.

23. The apparatus of claim 19, wherein the element for comparing comprises a comparator connected to the element for detecting the respective distances and to a reference voltage voltage source.

* * * * *